United States Patent [19]

Mraovich

[11] 4,264,453

[45] Apr. 28, 1981

[54] RECLAMATION OF COKING WASTES

[75] Inventor: George Mraovich, Georgetown, Pa.

[73] Assignee: Pori International, Inc., Baltimore, Md.

[21] Appl. No.: 111,021

[22] Filed: Jan. 10, 1980

[51] Int. Cl.[3] ..... C10G 1/06

[52] U.S. Cl. ..... 210/774; 210/800; 208/13; 208/45

[58] Field of Search ..... 208/13, 45, 180; 210/54 R, 43, 67, 73 W

[56] References Cited

U.S. PATENT DOCUMENTS

| | | | |
|---|---|---|---|
| 3,692,668 | 9/1972 | McCoy et al. | 208/13 |
| 3,696,021 | 10/1972 | Cole et al. | 208/13 |
| 3,856,668 | 12/1974 | Shubert | 210/54 R |
| 3,992,281 | 11/1976 | Benade | 208/45 |
| 4,014,780 | 3/1977 | McCoy | 208/13 |
| 4,124,485 | 11/1978 | Carr et al. | 210/54 R |

*Primary Examiner*—Benoit Castel

*Attorney, Agent, or Firm*—Fidelman, Wolffe & Waldron

[57] ABSTRACT

Waste products derived from coking coal, such as coal tar decanter wastes and wash oil muck, are processed to recover an oil fraction and a granular coke breeze residue. The wastes are mixed with a diluent oil, preferably having a saponification number of about 100 or more, are subjected to agitation and mixing and are thereafter filtered to produce a granular, coke breeze cake and a filtrate comprising water and oil which separate easily by decantation.

10 Claims, 1 Drawing Figure

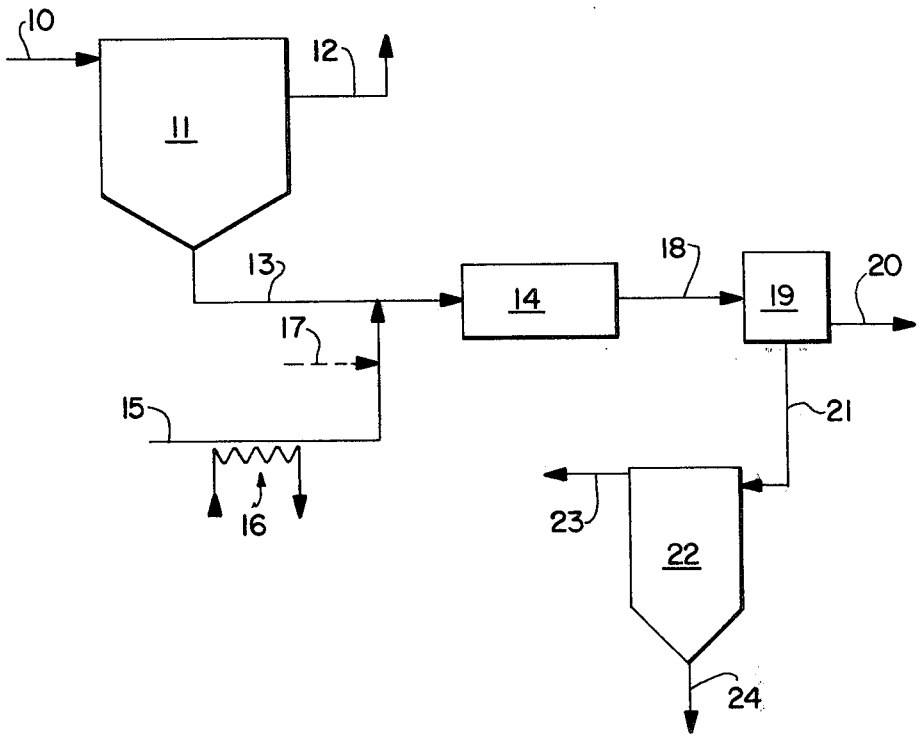
10
11
12
13
14
15
16
17
18
19
20
21
22
23
24

RECLAMATION OF COKING WASTES

BACKGROUND OF THE INVENTION

1. Field of the Invention

This invention relates generally to the reclamation of coking wastes.

More specifically, this invention relates to the treatment of tar decanter sludges, wash oil muck and like wastes to produce an oil fraction suitable in use as a fuel oil and a coke breeze fraction having high fuel value.

A preferred embodiment of this invention utilizes a reclaimed rolling oil as a treating agent in the process.

2. Description of the Prior Art

The coking of coal produces a variety of volatile products. These volatile products of carbonization comprise a mixture of permanent gases; condensible vapors of water, ammonia and various organic compounds including benzene, toluene, naphtalene and related compounds; and finely divided liquid and solid droplets or particles of tar and coke breeze. Coal tar and much of the coke breeze are separated from the coke oven off-gas by cooling in condensers. The residual cooled gases pass through a series of subsequent scrubbing steps including a light oil recovery stage.

Condensed coal tar, comprising a mixture of tar, water and coke breeze, is typically passed to a decanter from which a coal tar fraction is separated. The decanting step also produces a waste fraction, known as tar decanter waste or sludge which typically contains some 30 to 60% by weight of coke breeze solids and varying amounts of water in addition to coal tar. The tar decanter waste is a very viscous material, difficult to pump and inconvenient to handle as a solid. It is usually considered a useless waste material disposed of by land filling although some attempts have been made to recycle it to the coal charge supplied to the coking ovens.

Light oils are commonly removed from cooled coke oven off-gases by absorption in a suitable wash oil which is usually a petroleum distillate boiling above about 250° C. The light oil which comprises aromatic compounds including benzene, toluene, xylenes and naphthalene, is stripped from the wash oil by distillation and the wash oil is cooled and then recirculated to the gas scrubbers. Another waste product, known as wash oil muck, is produced during this process.

The wash oil muck is a semi-liquid having the appearance and flow characteristics of a black mayonnaise. Its composition includes wash oil, light oil, finely divided coke breeze and water. Like tar decanter sludge, the wash oil muck if generally considered a worthless by-product usually disposed of by land filling. Both products, of course, have considerable fuel value but neither can be utilized in conventional fuel burning devices.

A coal tar is also produced during the gasification of coal as in the Lurgi process. It is known, as is taught by the Benade Pat., U.S. Pat. No. 3,992,281, to separate such tar from solid contaminants comprising chiefly coal dust and ash. Benade accomplishes this result by mixing with the residual tar a light oil, presumably aromatic, derived from the processing of that same tar. Light oil and tar residue are mixed together by flow through a pipe and then passed to a gravity separator. A clear, dissolved tar is drawn off the top of the separator while settled solids and water are drawn off the bottom.

SUMMARY OF THE INVENTION

Coal tar wastes are rendered amenable to separation by filtration followed by decantation to produce a granular coke breeze filter cake, an oil-free water fraction and a clean and essentially dry oil fraction by mixing with the waste a non-aromatic diluent oil preferably having a relatively high saponification value. The waste and diluent oil mixture is subjected to agilation and mixing, as by ball milling, at moderately elevated temperatures to produce a readily filterable material. The filter cake and oil fraction recovered by use of the process are of high fuel value.

Hence, it is an object of this invention to recover valuable fuel fractions from coking wastes.

It is another object of this invention to provide a process for the reclamation of waste fractions produced in the coking of coal.

It is a specific object of this invention to recover a readily handleable, granular coke breeze fraction and a clean oil fraction from coal tar decanter wastes and wash oil mucks.

BRIEF DESCRIPTION OF THE DRAWING

The FIGURE comprises a stylized flow sheet illustrating preferred embodiments of the invention.

DETAILED DESCRIPTION OF THE INVENTION

Exemplary as well as preferred embodiments of the invention will be described with reference to the FIGURE which comprises a flow diagram illustrating the method steps for recovering clean fuel fractions from coking wastes.

Referring now to the FIGURE, a coal tar stream 10, recovered from coke oven off-gases by condensation, is passed to coal tar decanter 11. A first stream 12, comprising coal tar suitable for sale or for further processing, is removed from an upper level of the decanter. A coal tar decanter waste stream 13 is periodically or continuously removed from the bottom of decanter 11. Stream 13, in conventional practice, is disposed of as a valueless waste in landfill.

In the process of this invention, stream 13 is passed to a mixing and agitating means 14. Means 14 comprise, in a preferred embodiment, a ball mill but other types of mixers such as those of the muller type may be used as well.

A diluent oil 15 is either merged with waste stream 13 as is shown in the drawing or is introduced directly into agitating means 14. The diluent oil may be adjusted in temperature by heat exchange means 16 to a level which will provide a temperature of ranging broadly from about 140° F. to about the boiling point of water or 212° F. A more preferred temperature for the agitation and mixing step ranges from about 150° to 180° F.

Selection of the diluent oil is influenced to a large extent by the type, or origin, of the coking coal. Some coking coals produce a tar decanter residue which is amenable to reclamation using a diluent oil of non-aromatic type such as the mid-range fuel oils. Mid-continent coals fall generally into this category. Other coking coals, especially southeastern coals, require use of a diluent oil having a relatively high saponification number or value. In such cases, it is highly preferred to use as the diluent oil a reclaimed rolling oil or mixtures of such oils with fuel oils and the like. Diluent oils having a relatively high saponification value; i.e., a minimum saponification number greater than about 100, have proven effective for reclamation of all tar decanter wastes whatever their type or origin and so constitute a preferred embodiment of this invention. It has also been found that results generally equivalent to these obtained using reclaimed rolling oils may be achieved by adding a saponifiable material, such as tallow oil and the like, to a diluent oil such as a fuel oil in an amount sufficient to provide an appropriate saponification value. The saponifiable material may be added to the diluent oil via conduit 17.

Reclaimed rolling oil is obtained by processing the degraded oils used as lubricating agents in the cold working of steel. The virgin rolling oils are tallow based and comprise mixed triglycerides. Reclaiming may be accomplished by acid treating, filtering and washing the degraded oil. The reclaimed oil often is substantially reduced in saponification value as compared to the virgin oil. Virgin rolling oil, of course, could be used as a diluent in the inventive process were economic considerations to be disregarded. Virgin oil can, however, find use as the saponifiable material blended with another diluent oil.

Aromatic diluents such as benzene are not appropriate for use in the process. Use of benzene as a diluent consistently produced substantially poorer results than did the preferred diluents described above. This in spite of the fact that the tar constituents are aromatic in nature and disperse and dissolve well in an aromatic solvent such as benzene. However, filtration rates obtainable using benzene as a diluent are very low compared to the preferred diluents of this invention.

The ratio of diluent oil to coking waste is not critical so long as enough diluent oil is used to produce a readily filterable mixture. Diluent oil to coking waste weight ratios may broadly range from about 1:3 to in excess of 3:1. Preferred ratios run from about 1:2 to 2:1 while consistently good results have been obtained at a ratio of about 1:1.

The mixture of coking waste and diluent oil is subjected to agitation in mill 14 for a time sufficient to cause homogenization of the mix to produce a readily filterable material. Time required will broadly range from a few minutes to several hours. For most diluent-waste combinations, mixing time in a ball mill ranging from about 15 minutes to 1½ hours is appropriate.

From agitation means 14, the mixture is passed via conduit 18 to filter 19. Filter 19 may comprise a conventional pressure or vacuum leaf or drum filter. The filtration step produces a granular filter cake 20 consisting primarily of relatively finely divided coke particles or breeze. Cake 20 has a heat content equal to or surpassing that of a high quality steam coal and may be burned in conventional coal fired boilers. Alternatively, cake 20 may be blended with powdered coal, briquetted, and used as a stoker feed or the like.

Filtrate 21 comprises an admixture of water and diluent oil-tar. It readily separates upon settling as in decanter 22 to a two-phase system: a clean and dry oil phase 23 and an oil-free water phase 24. The oil has the characteristics of a high grade fuel oil and may advantageously be used as such. Water phase 21 may be further subjected to biological treatment as in a trickling filter and is thereafter suitable for stream disposal. Alternatively, the recovered water may be recycled for many process uses without further treatment.

When wash oil muck rather than tar decanter sludge is being processed, it may be advantageous to subject the muck to a pre-treatment step prior to processing as above described. This pre-treatment step comprises adding a demulsifying agent to the muck with mixing. Thereafter, the muck is allowed to settle to form a three-phase system. Some of the contained oil and water will be freed with an oil layer floating atop a water layer. A solids-containing residue or bottoms layer may then be processed in the manner described above.

The following examples more fully illustrate specific embodiments of the invention.

EXAMPLE 1

A quantity of a reclaimed fatty oil having a saponification number of 150 was heated to 150° F. with agitation. An equal weight of coal tar decanter waste was added and the resulting mixture was heated to 180° F. and agitated for 15 minutes. The mixture was then subjected to vacuum filtration using a thin pre-coat of filter aid at 5" Hg vacuum. The resulting filtrate settled into a relatively clean and dry oil layer at the upper portion of the vessel and an oil free aqueous phase near the bottom of the vessel. A granular material, coke breeze, formed the filter cake.

EXAMPLE 2

A diluent oil consisting of one part by weight of a reclaimed fatty oil having a saponification number of 135 and two parts by weight of a 300 second viscosity mineral oil was heated to 180° F. with agitation. An equal weight of coal tar decanter waste was added and the mixture was agitated for 15 minutes while maintaining the temperature at 180° F. Thereafter, the mixture was vacuum filtered as in Example 1 but at a vacuum of 7" Hg. The filtration was rapid and the resulting filtrate settled into a clean and dry oil layer and an oil free aqueous phase. The resulting filter cake was of a granular nature.

EXAMPLE 3

A diluent oil comprising a reclaimed fatty oil having a saponification number of 109 was heated to 180° F. with agitation. Two parts by weight of wash oil muck was added to one part diluent oil along with 0.25% (based on muck weight) of a demulsifier of the type designed to resolve a water-in-oil emulsion. The mixture was maintained at 180° F. for 1 hour with agitation. Upon vacuum filtration as in Example 1, the filtrate settled into a relatively clean and dry oil layer at the upper portion of the vessel and an oil free aqueous phase near the bottom of the vessel. A granular material, coke breeze, formed the filter cake.

EXAMPLE 4

A quantity of relatively low viscosity mineral oil having a zero saponification number was heated to 170° F. A coal tar decanter waste from a source different from that of Example 1 was added to the mineral oil in an amount equal to twice the weight of the mineral oil. The mixture was heated to 180°, agitated for one hour, and thereafter subjected to vacuum filtration. The material filtered readily but at 15 inches vacuum. Recovered filtrate separated readily into a clean and dry oil layer and an oil-free aqueous phase. The filter cake was granular in nature.

EXAMPLE 5

Four pairs of comparative runs were made on two different tar decanter sludges. One sludge sample, designated Sample A was derived from the coking of a mid-continent coal. The second sample, designated Sample B, was from a southeastern coal. In all cases, the diluent oil-sludge mixtures were agitated by ball milling for 1 hour at a temperature maintained between 165° and 170° F. The ball milled mixtures were thereafter filtered under identical conditions at 15" vacuum. Diluent oil to sludge ratios were maintained at 1:1 for all tests.

The following results were obtained.

TABLE

| Run No. | Sample | Diluent | Relative Filtration Time | Comments |
|---|---|---|---|---|
| 1 | A | No. 2 Fuel Oil | 1 | Processed well |
| 2 | B | No. 2 Fuel Oil | — | Could not filter; large tarry lumps. |
| 3 | A | Reclaimed rolling oil; Sap. No. 125 | 8 | Processed well |
| 4 | B | Reclaimed rolling oil; Sap. No. 125 | 1 | Processed well |
| 5 | A | 80% No. 2 fuel oil 20% tallow | 2 | Processed well |
| 6 | B | 80% No. 2 fuel oil | 1.5 | Processed well |
| 7 | A | Benzene | 16 | Processed well |
| 8 | B | Benzene | 12 | Processed well |

As is evident from a review of the data presented in the Table, source of the coking waste influences the results obtained with any particular diluent. This is most evident with a diluent such as fuel oil having a zero saponification number. Diluents having a significant degree of saponification activity, such as reclaimed rolling oils and fuel oils with added saponifiable material produce good to excellent results with coking wastes of whatever origin. An aromatic solvent, benzene, produced results substantially poorer, as measured by filterability of the treated material, than did any diluent having saponification activity.

It may now be appreciated that the invention of this application provides a method for reclaiming formerly useless waste materials with the concomitant recovery of valuable solid and liquid fuels. It also helps to alleviate potential ground water pollution problems by providing an alternative to landfilling coking wastes.

Although the invention has been described and illustrates in detail, it will be understood by those skilled in the art that many variations in detail are possible without departing from the scope of the appended claims.

What is claimed is:

1. A process for reclaiming waste materials selected from the group consisting of tar decanter sludge, wash oil muck and like wastes which are derived from coking coal and contain tars, water and finely divided coke particles comprising:

adding a non-aromatic diluent oil to said waste in a ratio of diluent oil to waste of at least 1:3, mixing said oil and waste at a temperature above about 140° F. but below 212° F. for a time sufficient to cause homogenization of the mixture to produce a readily filterable product;

filtering said mixture to recover a granular filter cake comprising coke particles and a filtrate comprising oil and water allowing said filtrate to settle to form an oil phase and a water phase; and separating said oil phase from said water phase to recover a liquid hydrocarbon fraction suitable for use as a fuel oil.

2. The process of claim 1, wherein said diluent oil has a saponification number greater than about 100.

3. The process of claim 2, wherein said waste material is a tar decanter sludge.

4. The process of claim 3, wherein said diluent oil is a reclaimed rolling oil.

5. The process of claim 3, wherein said diluent oil is a mineral oil with added saponifiable material.

6. The process of claim 5, wherein said mineral oil is a fuel oil.

7. The process of claim 1, wherein the ratio of diluent oil to waste material is in the range of 1:2 to 2:1.

8. The process of claim 7, wherein said mixing comprises ball mixing for a time in excess of 15 minutes.

9. The process of claim 8, wherein said diluent oil is a reclaimed rolling oil having a saponification number greater than about 100.

10. The process of claim 2, wherein said waste is a wash oil muck and wherein a demulsifier is added to the diluent oil waste mixture.

* * * * *